US007299758B1

(12) United States Patent
Bogart

(10) Patent No.: US 7,299,758 B1
(45) Date of Patent: Nov. 27, 2007

(54) APPARATUS FOR TRANSPORTING BOAT LIFTS

(76) Inventor: Jonathan J. Bogart, 1037 N. Horsepound Rd., Carmel, NY (US) 10512

( * ) Notice: Subject to any disclaimer, the term of this patent is extended or adjusted under 35 U.S.C. 154(b) by 0 days.

(21) Appl. No.: 11/591,134

(22) Filed: Oct. 31, 2006

(51) Int. Cl.
*B63C 7/00* (2006.01)

(52) U.S. Cl. ..... 114/44; 405/3

(58) Field of Classification Search ..... 114/44, 114/45, 48, 49, 52; 280/414.1; 405/3, 4, 405/7

See application file for complete search history.

(56) References Cited

U.S. PATENT DOCUMENTS 4,027,492 A 6/1977 Carpenter
4,318,632 A 3/1982 Fortmeyer
5,562,362 A * 10/1996 Vezner ..... 405/3
5,687,663 A 11/1997 Wahlstrand

* cited by examiner

*Primary Examiner*—Lars A. Olson
(74) *Attorney, Agent, or Firm*—Steven Horowitz

(57) ABSTRACT

A boat lift transportation assembly for boat lifts is attachable to and removable from any cantilever boat lift. It comprises a steerable front lever that is positioned adjacent the front upper and lower cross-members of the boat lift and left and right rear levers positioned adjacent the rear upper and lower cross-members. Each lever has a wheel on the bottom so that the boat lift is automatically placed on wheels when the boat lift is raised, provided the levers have been positioned previously. Besides the wheel on the bottom, each lever has a height adjustable beam having a lower and upper hook. The boat lift's lower cross-members sit on the rest areas of the lower hooks and the boat lift's upper cross-rnembers are restricted by the upper hooks.

15 Claims, 4 Drawing Sheets

APPARATUS FOR TRANSPORTING BOAT LIFTS

FIELD OF THE INVENTION

The field of this invention is boat lifts, and more particularly, cantilever boat lifts and how to get them in and out of the water conveniently.

BACKGROUND OF THE INVENTION AND DISCUSSION OF THE PRIOR ART

Boat lifts are used by boat owners to elevate boats above the water when they are not being used and to lower them back into the water for usage. For example, during the summer season, boat owners use the boat lift to lift boats out of the water to avoid damage from rough waters rocking the boat against the dock..

Boat lifts can be classified by the mechanisms they employ for raising and lowering the boat. Thus there are cantilever boat lifts, vertical boat lifts and hydraulic boat lifts. Cantilever boat lifts have a frame comprising a lower quadrilateral frame and an upper quadrilateral frame with vertical frame members connecting them. The lower and upper frames each have cross-members. Some kind of leveraging mechanism, employing for example a winch, is used to pivot the vertical frame members in unison so as to raise and lower the upper frame members in relation to the lower frame members.

The problem is that the boat lifts themselves have to be moved in and out of the water, depending on the season. It is not advisable to leave your boat lift in freezing water during the winter, for example. This is because it will cause ice damage to the boat lift and to the boats.

The prior art features permanent attachments to cantilever boat lifts designed to help move the boat lifts in and out of the water. For example, U.S. Pat. No. 4,318,632 to Fortmeyer is a permanent attachment to a cantilever boat lift.

To date, there are many problems associated with mechanisms used for moving cantilever boat lifts in and out of the water. It should be noted that it is very common for boat owners to have multiple boats; sometimes half a dozen or more. Each boat has its own boat lift permanently affixed to it. Accordingly, when the mechanism for lifting the boat lift is permanently affixed to each of the boat lifts, the cost of such a mechanism must be multiplied by the number of boats. Furthermore, these mechanisms take up storage space.

Accordingly, there is a strong need to have a way of moving cantilever boat lifts in and out of the water that is less expensive. Furthermore, boat lifts are made by different manufacturers. There is a therefore a further need to have such a boat lift transportation mechanism that is compatible for all models of boat lifts regardless of their manufacturer.

The present invention presents a novel, long-awaited solution to these problems and offers yet additional advantages.

SUMMARY OF THE PRESENT INVENTION

A boat lift transportation assembly for boat lifts is attachable to and removable from any cantilever boat lift. It comprises a steerable front lever that is positioned adjacent the front upper and lower cross-members of the boat lift and left and right rear levers positioned adjacent the rear upper and lower cross-members. Each lever has a wheel on the bottom so that the boat lift is automatically placed on wheels when the boat lift is raised, provided the levers have been positioned previously. Besides the wheel on the bottom, each lever has a height adjustable beam having a lower and upper hook. The boat lift's lower cross-members sit on the rest areas of the lower hooks and the boat lift's upper cross-members are restricted by the upper hooks.

The front lever has an upper and lower segment that rotate relative to one another to allow steering of the assembly and boat lift.

IMPORTANT OBJECTS AND ADVANTAGES

The following important objects and advantages of the present invention are:

(1) to provide a boat lift transportation assembly;

(2) to provide a boat lift transportation assembly that is inexpensive;

(3) to provide a boat lift transportation assembly that is easy to operate;

(4) to provide a boat lift transportation assembly that is adaptable to a cantilever boat lift of all manufacturers;

(5) to provide a boat lift transportation assembly that is light weight;

(6) to provide a single boat lift transportation assembly that can be used for multiple cantilever boat lifts;

(7) to provide a boat lift transportation assembly that uses the cantilever boat lift's own mechanism for being lifted in order to put the assembly into proper position;

(8) to provide a cantilever boat lift transportation assembly that is easy to manufacture;

(9) to provide a boat lift transportation assembly that attaches to the cross-members of a boat lift;

(10) to provide a boat lift transportation assembly that is steerable;

(11) to provide a boat lift transportation assembly that obviates the need for a jack when adjusting the legs of the boat lift;

(12) to provide a boat lift transportation assembly that is a comprised of three levers;

(13) to provide such a boat lift transportation assembly wherein each lever of the assembly is height-adjustable;

(14) to provide a boat lift transportation assembly that is compatible with any cantilever mechanism used by cantilever boat lifts for raising and lowering the boat lift;

(15) to provide a boat lift transportation assembly that can be operated by a single person;

(16) to provide a boat lift transportation assembly that be operated to move the boat lift into the water and out of the water easily;

(17) to provide a boat lift transportation assembly that includes a stabilizing member for accommodating rocky water bottom surfaces;

(18) to provide a boat lift transportation mechanism that is easily adaptable to cantilever boat lifts of different heights and to cantilever boat lifts having different lengths of spaces between their upper and lower cross members; and

(19) to provide an apparatus and method for placement of a boat lift onto wheels for transporting the boat lift.

DETAILED DESCRIPTION OF THE PREFERRED EMBODIMENT

Figure 1:
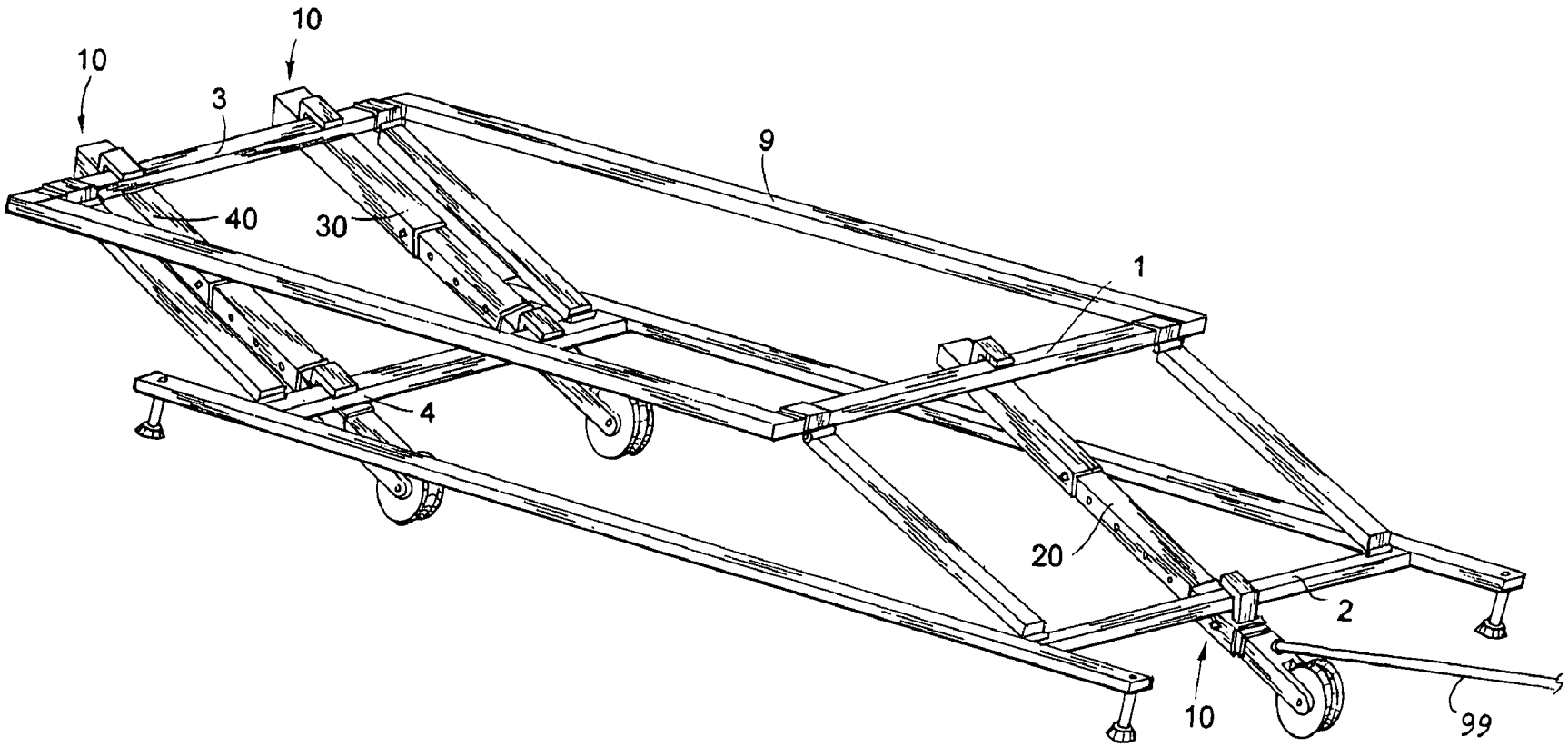
FIG. 1 is a perspective view of the boat lift transportation assembly of the present invention position adjacent a cantilever boat lever in a mostly lowered position.

While the instant invention can be embodied in many different forms, preferred embodiments of the invention are shown in the drawings and are described below in detail. It should be understood that the present disclosure should be considered an exemplification of the principles of the invention and is not intended to limit the principles or scope of the invention to the embodiment illustrated.

The boat lift transportation assembly of the present invention has been assigned reference numeral 10 Other elements have been assigned the reference numerals referred to below.

Figure 2:
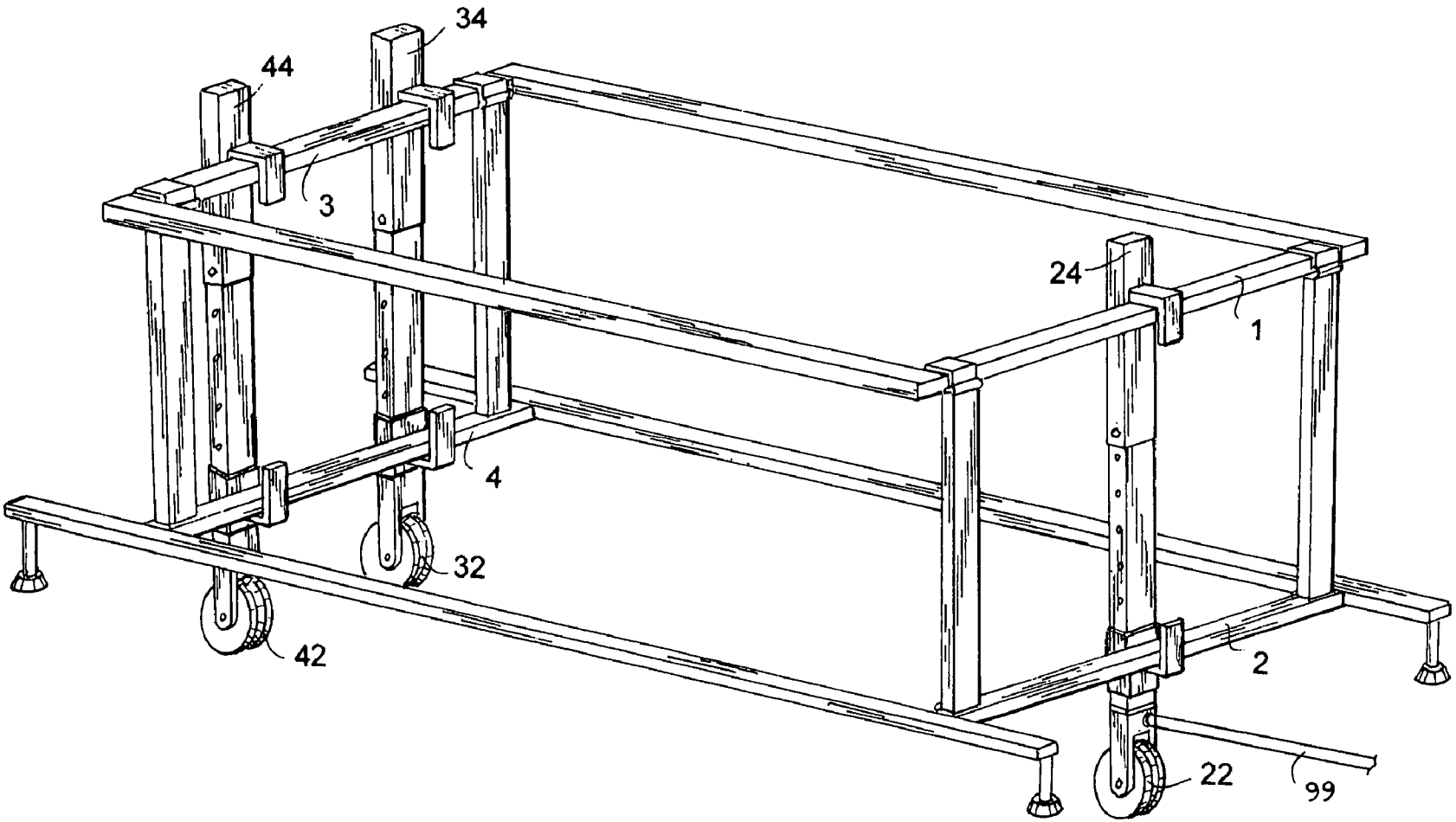
FIG. 2 is a perspective view of the assembly and boat lift of FIG. 1 but in a fully raised position.
Figure 5B:
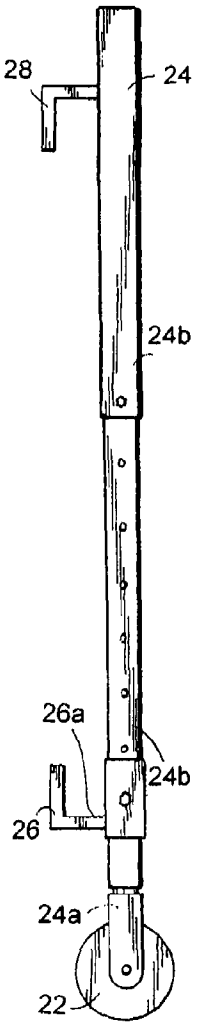
FIG. 5B is a right side elevation view of the front lever of the boat lift transportation assembly of the present invention in its normal unrotated position.
Figure 5A:
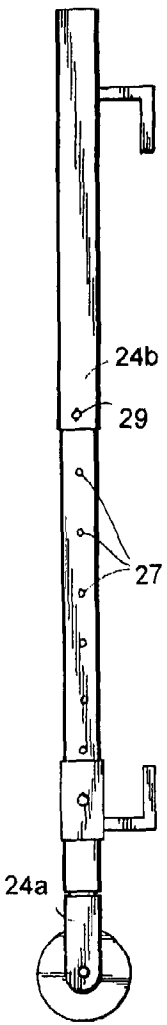
FIG. 5A is a left side elevation view of the front lever of the boat lift transportation assembly of the present invention in its normal unrotated position.
Figure 4B:
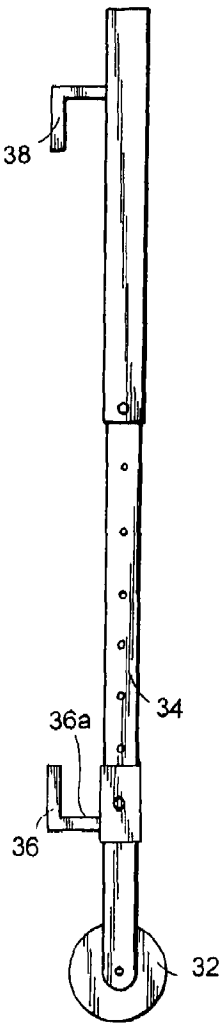
FIG. 4B is a right side elevation view of a right rear lever of the boat lift transportation assembly of the present invention.
Figure 4A:
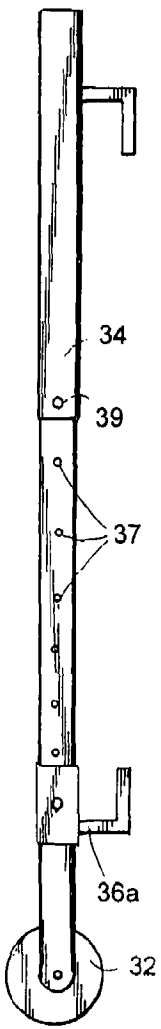
FIG. 4A is a left side elevation view of a right rear lever of the boat lift transportation assembly of the present invention.
Figure 3B:
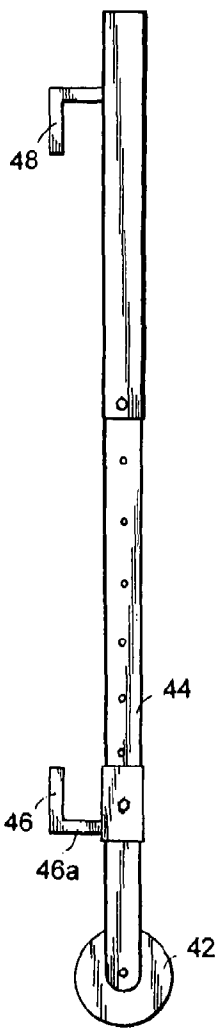
FIG. 3B is a right side elevation view of a left rear lever of the boat lift transportation assembly of the present invention.
Figure 3A:
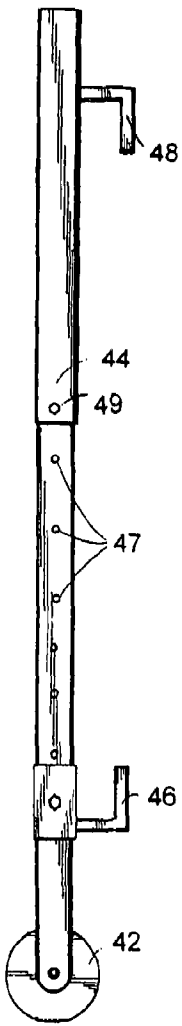
FIG. 3A is a left side elevation view of a left rear lever of the boat lift transportation assembly of the present invention.
Figure 6:
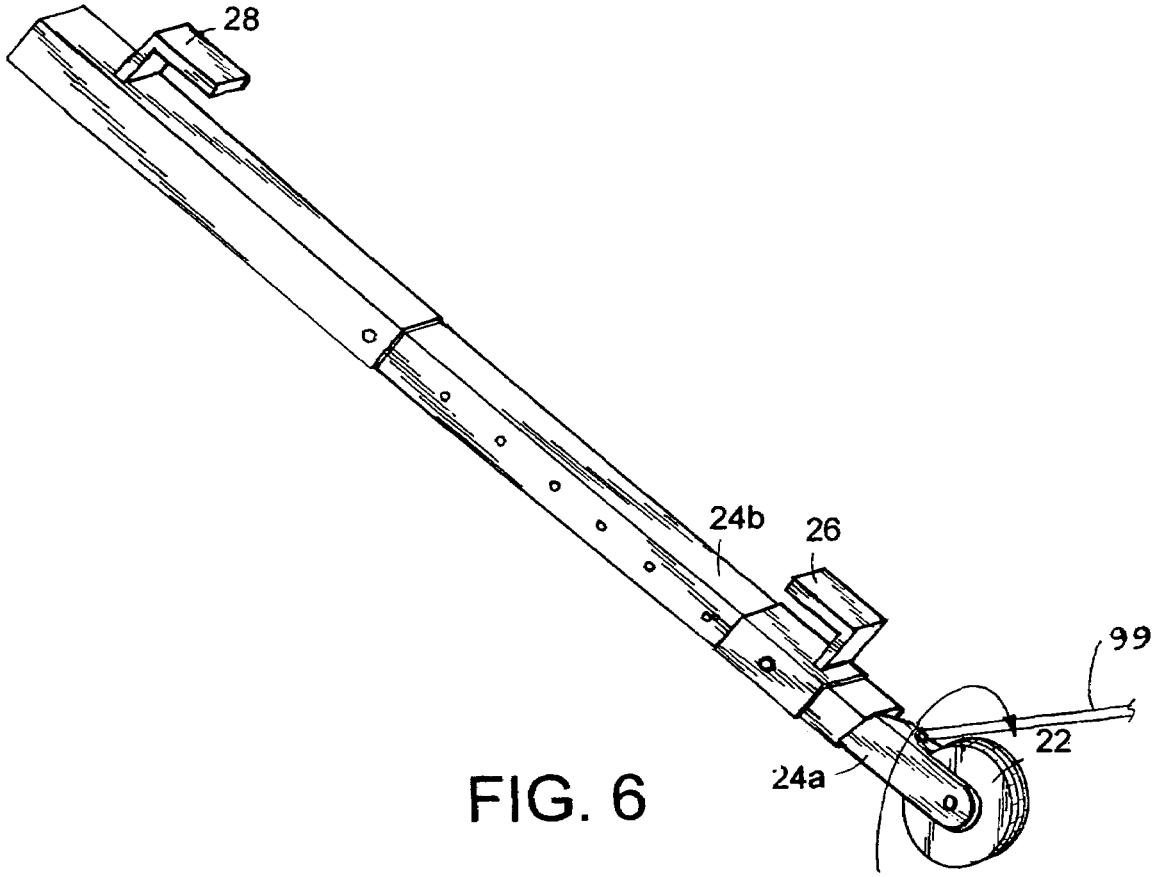
FIG. 6 is a perspective view of the front lever of FIG. 5 wherein the upper segment of the beam of the front lever is rotated relative to the lower segment of the beam of the front lever.
Figure 7:
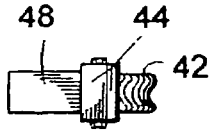
FIG. 7 is a top view of the left rear lever of the assembly of the present invention, the top view of the other two levers of the assembly being identical..

As seen from FIGS. 1-7, boat lift transportation assembly 10 is used for transporting cantilever boat lifts 9 that are of the kind having a frame, the frame including an upper front cross-member 1, a lower front cross-member 2, an upper rear cross-member 3 and a lower rear cross-member 4. These boat lifts 9 are raised and lowered by various mechanisms. One example of such a mechanism is a winch. The frame of the lift 9 is able to rotate to and from a raised position by virtue of the pivoting of the four vertical members from pivot points along the lower cross members and along the upper cross-members. Since the lower cross-members are fixed to each other by cross bars, the lift 9 moves from a lowered position to a raised position and the side walls move from parallelograms to rectangles.

Assembly 10 is designed to be raised and/or lowered automatically when the boat lift 9 is raised and/or lowered. For example, the boat lift 9 may have a winch that forces the vertical frame members to pivot in unison and thereby raise and/or lower the upper frame members in relation to the lower frame members. Whatever mechanism boat lift 9 uses to raise and lower itself is the very mechanism that is used to raise and lower assembly 10. In use, the three levers of assembly 10 are positioned, as described below, adjacent cross-members of boat lift 9 while the boat lift 9 is in the lowered position. Then, the winch or other mechanism lifts the boat lift 9 to its raised position. In so doing, the levers of assembly 10 are also raised and placed into their final position. The assembly 10 is now ready to pull boat lift 9.

Assembly 10 comprises a front lever 20. Front lever 20 includes front wheel 22 and height-adjustable front beam 24. Front beam 24 has a front lower hook 26 which in turn has rest area 26*a* on which the lower front cross-member 2 rests and an upper hook 28 that limits movements of the upper front cross-member 1. Front beam 24 also includes a bottom segment 24*a* extending from a point below the front lower hook 26 and continuing to a bottom of the front beam 24 and a top segment 24*b*. Top segment 24*b* is capable of being rotated relative to the bottom segment 24*a* so as to enable a user to steer assembly 10 when assembly 10 is positioned operatively with a boat lift 9. Note that assembly 10 is not actually affixed structurally to boat lift 9.

Assembly 10 also includes right rear lever 30. Right rear lever 30 includes a right rear wheel 32 and a height-adjustable right beam 34. Right beam 34 has a right rear lower hook 36 which in turn has rest area 36*a* on which the lower rear cross-member 4 rests and an upper hook 38 that limits movement of the upper rear cross-member 3.

Assembly 10 further includes left rear lever 40. Left rear lever 40 includes a left rear wheel 42 and a height-adjustable left beam 44. Left beam 44 has a left rear lower hook 46 which in turn has rest area 46*a* on which the lower rear cross-member 4 rests and an upper hook 48 that limits movement of the upper rear cross-member 3.

It should be clearly understood that the term "hook" as used in this patent application is a very broad term which also encompasses structures or members that extend a traditional hook into a full encircling enclosure.

In a preferred embodiment, the front beam 24, right beam 34 and left beam 44 are all made from aluminum or another lightweight but sturdy, durable and rigid material. In a poorer alternative embodiment, the beams 24, 34, 44 are made of wood. The shape of the cross-section of front beam 24, right beam 34 and left beam 44 is that they have a substantially rectangular cross-section. A "substantially rectangular" cross-section, for example with respect to the front, right and left beams, shall be understood to include (although not be limited to) rectangles with rounded corners.

In a preferred embodiment, wheels 22, 32, 42 are at the very bottom of levers 20, 30, 40. For example, in a preferred embodiment, as best seen from FIG.6 front wheel 22 is situated in a space carved out at a bottom of the front beam 24, right rear wheel 32 is situated in a space carved out at a bottom of the right rear beam 34 and left rear wheel 42 is situated in a space carved out of a bottom of the left rear beam 44. Wheels 22, 32, 42 should be wide enough to establish proper traction along the bottom of the water. For example, in a preferred embodiment, wheels 22, 32, 42 should be at least four inches wide. Furthermore, it is preferred that wheels 22, 32, 42 should have a dip in a central area of their width in order to increase traction. The present invention contemplates any kind of wheel that is effective at carrying boat lift 9 reliably across a water bottom. It is noted that the boat lift 9 is not moved that far a distance typically to and from the water. Both the wheels 22, 32, 42 and the manner in which the wheels are connected to the beams 24, 34, 44 can vary from what is depicted in the drawings herein.

Although the drawings depict only front beam of front lever 20 as having two segments wherein the bottom segment including the front wheel 22 is rotatable relative to the upper segment for steering purposes and do not depict left and right rear levers 30, 40 as steerable, in certain embodiments, any, none or all of the wheels can be steerable using any appropriate structure including the one depicted for front beam of front lever 20-namely that one or more of the rear beams are composed of an upper and lower segment wherein the lower segment containing the wheel is capable of being rotated relative to the upper segment thereof.

As can be seen from the FIGS. 1-7, the front lower hook 26 and front upper hook 28 face each other in that lower hook 26 faces up whereas upper hook 28 faces down. This is because lower hook 26 actually contains a resting area for lower front cross-member 2, whereas upper hook 28 does not allow upper front cross-member 1 to rest on it. Rather, upper hook 28 merely limits the movement of upper front cross-member 1 when assembly 10 is pulling boat lift 9 along the bottom of the lake or the other water body. In this situation, the boat lift 9 often hits a bump on the bottom surface of the lake or other water body which would can jolt the boat lift and cause it to separate from levers 20, 30, 40 of assembly 10. This separation is prevented by the three upper hooks 28, 38, 48 of front lever 20 and right rear lever 30 and left rear lever 40.

When in use, assembly 10 is capable of being removably positioned adjacent the boat lift 9. Preferably, front lever 20 is adjacent an approximate midpoint of the lower front cross-member 2 and of the upper front cross-member 1. Use of the approximate midpoint of the front cross-members 1, 2 for the point of connection is obviously the most efficient manner in which to pull boat lift 9. The term "approximate" just means close enough to the midpoint to efficiently pull boat lift 9. In use, right rear lever 30 and left rear lever 40 are positioned adjacent the lower rear cross-member 4 and upper rear cross-member 3. Right rear lever 30 and left rear lever 40 are at a right and left side of the upper rear cross-member.

In a preferred embodiment, the levers 10, 20, 30 are best positioned behind their respective cross-members. So for example, front lever is situated behind an approximate midpoint of the lower and upper front cross-members, and wherein the right and left rear levers are situated behind the lower and upper rear cross-members. In an alternative embodiment, the levers 10, 20, 30 are positioned in front of their respective cross-members.

In a preferred embodiment, it is the front lever 20 that has an attachable connecting member 99 for pulling the assembly 10 when assembly 10 is connected to boat lift 9. In a preferred embodiment, that connecting member 99 is a simple rope. Connecting member 99, e.g. the rope 99, attaches preferably to the bottom segment 24*a* of front beam 24 of front lever 20. In this way, bottom segment 24*a* easily follows the pulling force behind the connection member 99 or rope 99 whenever steering takes place. It is contemplated by the present invention that any other suitable and effective means of pulling boat lift 9 with assembly 10 may be used.

In order to make sure that the three levers, 20, 30, 40, when positioned with the frame of the boat lift can raise the boat lift 9 off the bottom of the lake or other water body, there should be certain comparative distances maintained. For example, the distance, called the "first distance" from a bottom of the front wheel to the rest area 26*a* of the front lower hook 26 should exceed the distance from a bottom of a water body to a bottom of the lower front cross-member 2. Similarly, the distance (called the "second distance") from a bottom of the left rear wheel to a rest area 46*a* of the left rear lower hook 46 should exceed the a distance from a bottom of the water body to a bottom of a left side of the lower rear cross-member 4. Similarly, the distance (called the "third distance") from a bottom of the right rear wheel to a rest area 36*a* of the right rear lower hook 36 should exceed the a distance from a bottom of the water body to a bottom of a right side of the lower rear cross-member 4. In a preferred embodiment, the term "exceeds" in this paragraph means exceeds by at least a few inches in order to take into consideration the uneven topography of many water bottoms, i.e. a bottom of a lake or other water body.

Front beam 24, right beam 34 and left beam 44 are height adjustable using any mechanism that is suitable for assembly 10 and known to those skilled in the art now or in the future. In accordance with one simple mechanism to height adjustment that is shown in the drawings, for example, front beam 24, right beam 34 and left beam 44 can have, respectively, bolts 29, 39, 49 that can be screwed and unscrewed to fit in various holes 27, 37, 47 located at different heights in beams 24, 34, 44.

Although the terms front lever, left rear lever and right rear lever are used herein, and parts of such levers described herein such as front beam, left beam and right beam, describe particular levers in assembly 10 and their parts, these terms are not intended to limit the direction of motion of the assembly or how a particular lever or part thereof can be characterized.

It is to be understood that while the apparatus of this invention have been described and illustrated in detail, the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

What is claimed is:

1. A boat lift transportation assembly for transporting cantilever boat lifts that are of the kind having a frame that includes an upper front cross-member, a lower front cross-member, an upper rear cross-member and a lower rear cross-member, the assembly comprising:

a front lever including a front wheel and a height-adjustable front beam, the front beam having a front lower hook on which the lower front cross-member rests and an upper hook that limits movements of the upper front cross-member, a right rear lever including a right rear wheel and a height-adjustable right beam, the right beam having a right rear lower hook on which the lower rear cross-member rests and an upper hook that limits movement of the upper rear cross-member, a left rear lever including a left rear wheel and a height-adjustable left beam, the left beam having a left rear lower hook on which the lower rear cross-member rests and an upper hook that limits movement of the upper rear cross-member, the assembly capable of being removably positioned with the boat lift so that the front lever is adjacent the lower and of the upper front cross-members and so that the right and left rear levers are adjacent the lower and upper rear cross-members and the right and left rear levers are positioned toward a right and left side of the upper rear cross-member, wherein a first distance from a bottom of the front wheel to a rest area of the front lower hook exceeds a distance from a bottom of a water body to a bottom of the lower front cross-member, a second distance from a bottom of the left rear wheel to a rest area of the left rear lower hook exceeds a distance from a bottom of the water body to a bottom of a left side of the lower rear cross-member and a third distance from a bottom of the right rear wheel to a rest area of the right rear lower hook exceeds a distance from a bottom of the water body to a bottom of a right side of the lower rear cross-member, and wherein the assembly is designed to be raised automatically when the boat lift is raised and wherein the assembly is designed to be lowered automatically when the boat lift is lowered.

2. The boat lift transportation assembly of claim 1, wherein the front beam includes a bottom segment extending from a point below the front lower hook and continuing to a bottom of the front beam and a top segment capable of being rotated relative to the bottom segment when steering the assembly and boat lift.

3. The boat lift transportation assembly of claim 1, wherein the left rear wheel, the right rear wheel and/or the front wheel are steerable.

4. The boat lift transportation assembly of claim 3, wherein the assembly is capable of being positioned with the boat lift so that the front lever is situated behind an approximate midpoint of the lower and upper front cross-members, and wherein the right and left rear levers are situated behind the lower and upper rear cross-members.

5. The boat lift transportation assembly of claim 4, wherein the assembly is capable of being positioned with the boat lift so that when the boat lift is in a raised position the lower front cross-member rests on the rest area of the front lower hook and the lower rear cross-member rests on the rest area of the right rear lower hook and the left rear lower hook.

6. The boat lift transportation assembly of claim 3, wherein the front lever has an attachable connecting member for pulling the assembly when said assembly is connected to the boat lift.

7. The boat lift transportation assembly of claim 6, wherein the connecting member is a rope.

8. The boat lift transportation assembly of claim 5, wherein the front lever has an attachable connecting member for pulling the assembly when said assembly is connected to the boat lift.

9. The boat lift transportation assembly of claim 8, wherein the connecting member is a rope.

10. The boat lift transportation assembly of claim 3, wherein the front beam, right beam and left beam are made from aluminum.

11. The boat lift transportation assembly of claim 3, wherein the front beam, right beam and left beam have a substantially rectangular cross-section.

12. The boat lift transportation assembly of claim 3, wherein the front wheel is situated in a space carved out at a bottom of the front beam, wherein the right rear wheel is situated in a space carved out at a bottom of the right rear beam and wherein the left rear wheel is situated in a space carved out of a bottom of the left rear beam.

13. The boat lift transportation assembly of claim 3, wherein the front lever is situated adjacent an approximate midpoint of the lower and upper front cross-members.

14. The boat lift transportation assembly of claim 3, wherein the assembly is capable of being positioned with the boat lift so that the front lever is situated behind an approximate midpoint of the lower and upper front cross-members, and wherein the right and left rear levers are situated in front of the lower and upper rear cross-members.

15. The boat lift transportation assembly of claim 14, wherein the assembly is capable of being positioned with the boat lift so that when the boat lift is in a raised position the lower front cross-member rests on the rest area of the front lower hook and the lower rear cross-member rests on the rest area of the right rear lower hook and the left rear lower hook.

* * * * *